US008358955B2

(12) United States Patent
Echigo et al.

(10) Patent No.: US 8,358,955 B2
(45) Date of Patent: Jan. 22, 2013

(54) TRANSFER DEVICE AND IMAGE FORMING APPARATUS

(75) Inventors: Katsuhiro Echigo, Saitama (JP); Hajime Oyama, Chiba (JP); Takahiro Tamiya, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 744 days.

(21) Appl. No.: 12/487,216

(22) Filed: Jun. 18, 2009

(65) Prior Publication Data

US 2009/0324306 A1 Dec. 31, 2009

(30) Foreign Application Priority Data

Jun. 30, 2008 (JP) ..... 2008-171638

(51) Int. Cl.
*G03G 15/08* (2006.01)

(52) U.S. Cl. ..... 399/121; 399/313; 399/314

(58) Field of Classification Search ..... 399/121, 399/313, 314
See application file for complete search history.

(56) References Cited

U.S. PATENT DOCUMENTS

| | | | | |
|---|---|---|---|---|
| 5,599,645 | A | 2/1997 | Tamiya et al. | |
| 5,655,200 | A | 8/1997 | Oyama | |
| 5,740,492 | A | 4/1998 | Deki et al. | |
| 6,134,416 | A | 10/2000 | Tamiya | |
| 6,184,910 | B1 | 2/2001 | Sasaki et al. | |
| 6,556,804 | B1 * | 4/2003 | Lobel et al. | 399/306 |
| 6,611,672 | B2 | 8/2003 | Aoki et al. | |
| 6,618,565 | B2 | 9/2003 | Sawai et al. | |
| 6,701,100 | B2 | 3/2004 | Tamiya et al. | |
| 6,741,821 | B2 | 5/2004 | Sugino et al. | |
| 6,829,450 | B2 | 12/2004 | Tamiya et al. | |
| 7,308,226 | B2 | 12/2007 | Iino et al. | |
| 7,546,074 | B2 | 6/2009 | Oyama et al. | |
| 2006/0209151 | A1 | 9/2006 | Tamiya et al. | |
| 2008/0213010 | A1 | 9/2008 | Oyama et al. | |
| 2009/0074482 | A1 | 3/2009 | Oyama et al. | |

FOREIGN PATENT DOCUMENTS

| | | |
|---|---|---|
| JP | 2000-292988 | 10/2000 |
| JP | 2002-123114 | 4/2002 |
| JP | 2005-181862 | 7/2005 |
| JP | 2006-301577 | 11/2006 |
| JP | 3968342 | 6/2007 |
| JP | 4033435 | 11/2007 |

* cited by examiner

*Primary Examiner* — Walter L Lindsay, Jr.
*Assistant Examiner* — Benjamin Schmitt
(74) *Attorney, Agent, or Firm* — Oblon, Spivak, McClelland, Maier & Neustadt, L.L.P.

(57) ABSTRACT

A transfer device for use in an image forming apparatus includes at least two belt members constituting a secondary nip portion therebetween. The transfer device electrostatically transfers a toner image from one of the belt members onto a recording medium when the recording medium passes through the secondary nip portion. The transfer device includes a mechanism that supports the belt members such that the secondary nip portion is substantially linear; and a bias applying member that applies a secondary transfer bias at a substantially center portion of the secondary nip portion.

2 Claims, 6 Drawing Sheets

TRANSFER DEVICE AND IMAGE FORMING APPARATUS

CROSS-REFERENCE TO RELATED APPLICATIONS

The present application claims priority to and incorporates by reference the entire contents of Japanese patent application 2008-171638 filed in Japan on Jun. 30, 2008.

BACKGROUND OF THE INVENTION

1. Field of the Invention

The present invention relates to an image forming apparatus of an electrophotographic type such as a copier, a printer, a facsimile machine, or a complex machine having functions of these machines, and a transfer device incorporated therein.

2. Description of the Related Art

An image forming apparatus of an electrophotographic type, especially a color image forming apparatus, forms toner images of yellow, magenta, cyan, and black sequentially on corresponding image carriers, superimposes the images on an intermediate transferring body included in a transfer device with a primary transfer unit (primary transfer operation), and then transfers the color images altogether onto a transfer medium such as a sheet of paper with a secondary transfer unit (secondary transfer operation). The image forming apparatus of an electrophotographic type are exemplified by copiers, printers, facsimile machines, and multifunction peripherals having functions of these machines. In the primary and secondary transfer operations of the image forming apparatus that incorporates the transfer device using such an intermediate transfer body, toner images formed at the previous operation need to be transferred with a high degree of fidelity.

The high-fidelity transfer can be defined as transfer of "a toner amount" and "toner image geometries" with a high degree of fidelity. First, the fidelity of the transfer of a toner amount is expressed by a transfer rate. If the rate is insufficient, the image would not satisfy an essential image quality of "image density". The fidelity of the transfer of toner image geometries is expressed by a dot average area and dot area dispersion. If these values are insufficient, the image would not satisfy an essential image quality of "granularity (or graininess)". If the high-fidelity transfer fails to be attained at either one of the transfer operations, i.e., the primary transfer and the secondary transfer, the final image would not come out with high image quality.

The following four documents suggest structures having a wide transfer nip to improve the toner fidelity at the primary transfer unit. Japanese Patent Application Laid-open No. 2000-292988 describes a structure incorporating a corona transfer system, in which a transfer nip is formed of an image carrier and a pressing unit arranged at the entering side of the transfer nip.

Japanese Patent Application Laid-open No. 2002-006644 discloses a structure in which a roller supporting member is provided to support a transfer belt in such a manner to be opposed to the image carrier or to support a roller at the middle of its longitudinal direction from the inside of the transfer belt.

Japanese Patent Application Laid-open No. 2002-123114 discloses a structure that includes a fixing device having a fixing roll the elastic body of which is contorted by way of a heat-resisting belt by a pressure roll provided on the inside of the heat-resisting belt to fix the toner at the same time of the transfer.

Japanese Patent Application Laid-open No. 2006-301577 relates to a high quality image technology that regulates electric discharge and reduces dust by regulating an electric field in areas upstream and downstream of the transfer nip. It teaches that, by arranging a bias application electrode of a polarity opposite to the primary transfer bias polarity near the primary transfer bias electrode, discharge is suppressed in the outlet area of the primary transfer nip to suppress polarity reversal of the toner, or more specifically reverse transfer, and to achieve faithful transfer.

Japanese Patent Application Laid-open No. 2005-181862 discloses a simultaneous double-side transfer technology, with which toner images are transferred on double sides of a recording medium at the same time in the secondary transfer operation. In particular, in the operation of transferring toner images onto the two sides of the recording medium, a toner image on the first belt, which is an intermediate transfer belt, is transferred onto the opposing second belt at the first-side image forming step. Then, another toner image is formed on the intermediate transfer belt in the second-side image forming step. The recording medium is fed at a predetermined timing, and the toner images are transferred on the two sides of the recording medium by synchronizing the leading edges of the toner images for the first and second sides while carrying the recording medium on the first and second belts. Then, the first-side toner image formed in advance on the second belt is transferred onto the recording medium by applying a negative polarity voltage to the roller at the nip outlet on the downstream side of the transfer nip and using the first nip outlet roller on the inside of the first belt as an opposing roller. On the other hand, the second-side toner image is formed on the first belt at the timing of the leading edge of the recording medium entering the transfer nip, and transferred onto the recording medium by applying a voltage of negative polarity to the first nip inlet roller and using the second belt inlet roller as an opposing roller. In other words, the first-side and second-side toner images are transferred at different positions, i.e., the transfer nip inlet and outlet areas, to simultaneously complete double-sided images.

According to the first three patent documents, the transfer nip of the transferring unit is formed with a certain curvature. Because a toner image is transferred onto the surface of a recording medium as the recording medium is being carried with a nip curvature, instability factors may be increased regarding image displacement. Furthermore, when the recording medium is a thick sheet of paper, it tends to curl up and may cause malfunction in paper feeding. When the recording medium is an electrically charged sheet such as an insulating film, it may adversely wind around the feeding roller or a belt member. Furthermore, a curled up recording medium is not a preferable condition for the user.

According to Japanese Patent Application Laid-open No. 2006-301577, a certain transfer rate needs to be maintained to perform faithful transfer without disturbing a toner image and attain a sufficient image density in the process of transferring the toner image of the intermediate transfer belt onto a recording medium in the secondary transfer operation. In the secondary transfer operation, the toner image formed on the intermediate transfer body in the primary transfer operation is transferred onto the recording medium. From the aspect of faithful transfer, a problem arises that the toner of the toner image on the intermediate transfer body dissipates toward the recording medium under the action of the secondary transfer electric field at the secondary transfer nip inlet portion, before the toner image comes into contact with the recording medium, or in other words when there still is a gap between the toner image and the recording medium. This phenomenon is called "pre-transfer". The pre-transfer damages the original toner geometries, causing disturbances in dots and lines and generating toner dust. Another problem is a phenomenon called "separation discharge", which occurs when the recording medium is removed from the intermediate transfer body at the secondary transfer nip outlet portion immediately after the toner image is transferred onto the recording medium. This makes the polarity of the toner image on the recording medium unstable, and may cause reverse transfer or transfer failure due to the reversely polarized toner. As a result, the original toner geometries may be damaged, leaving disturbed dots and lines and toner dust.

According to Japanese Patent Application Laid-open No. 2005-181862, the secondary transfer bias is applied for the second side of the recording medium while the toner image on the second belt for the first side is brought into contact with the recording medium. This means that the first-side toner image is more or less influenced by the secondary transfer bias. On the other hand, from an aspect of the second-side toner image transfer, the transfer rate of the second-side toner image differs, depending on the first side carrying a toner image or not. In other words, the image patterns on the front and back sides may adversely influence each other. Furthermore, each of the inlet and outlet portions of the secondary transfer nip is formed of a pair of rollers. Pressure is sufficiently applied to the roller nip portions, but the portion sandwiched by the first and second belts only does not receive sufficient contact pressure or contact tightness between the intermediate transfer body and the recording medium. This may cause disturbances in the toner images if a difference, no matter how slight it is, is created in linear velocity. In addition, when the secondary transfer electric fields are applied separately onto the front and back sides of the recording medium in the inlet or outlet portion of the secondary transfer belt nip, the transfer electric fields may interfere with each other due to the large width of the nip.

SUMMARY OF THE INVENTION

It is an object of the present invention to at least partially solve the problems in the conventional technology.

According to an aspect of the present invention there is provided a transfer device that includes at least two belt members constituting a secondary nip portion therebetween and that electrostatically transfers a toner image from one of the belt members onto a recording medium when the recording medium passes through the secondary nip portion. The transfer device includes a mechanism that supports the belt members such that the secondary nip portion is substantially linear; and a bias applying member that applies a secondary transfer bias at a substantially center portion of the secondary nip portion.

According to another aspect of the present invention there is provided an image forming apparatus including an image forming unit that forms a toner image on a secondary belt member; and a transfer device. The transfer device includes at least one belt member constituting a secondary nip portion between the secondary belt member and that electrostatically transfers a toner image from secondary belt member onto a recording medium when the recording medium passes through the secondary nip portion; a mechanism that supports the secondary belt member and the belt member such that the secondary nip portion is substantially linear; and a bias applying member that applies a secondary transfer bias at a substantially center portion of the secondary nip portion.

According to still another aspect of the present invention there is provided a transfer device including at least two belt members constituting a secondary nip portion therebetween and that electrostatically transfers a toner image from one of the belt members onto a recording medium when the recording medium passes through the secondary nip portion; a supporting means for supporting the belt members such that the secondary nip portion is substantially linear; and a bias applying means for applying a secondary transfer bias at a substantially center portion of the secondary nip portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below with reference to the drawings.

Figure 1:
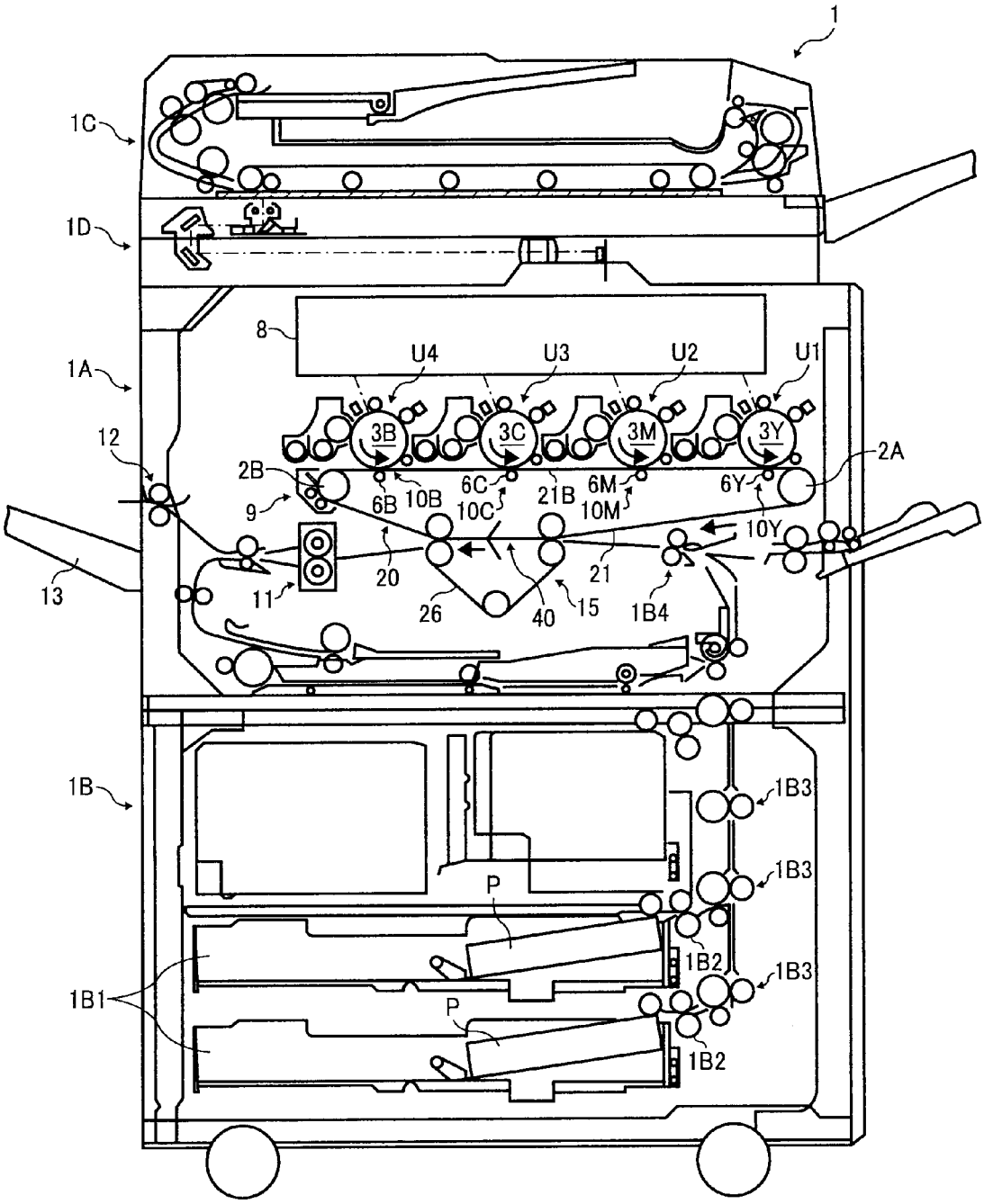
FIG. 1 is a schematic diagram of an internal structure of an image forming apparatus according to a first embodiment of the present invention.

The overview of the structure and operations of a tandem color copier 1 that is an example of an image forming apparatus of an electrophotographic type according to a first embodiment of the present invention is given with reference to FIG. 1. The color copier 1 includes an image forming section 1A positioned in the center of the device, a paper feeding section 1B positioned beneath the image forming section 1A, a document conveying section 1C positioned above the image forming section 1A, and a scanner section 1D.

The image forming section 1A includes a transfer device 20. The transfer device 20 includes an endless intermediate transfer belt 21 and it is wound around a plurality of rollers including rollers 2A and 2B. The intermediate transfer belt 21 has a transfer surface 21B extending in the horizontal direction and it serves as an intermediate transfer body. Four image forming units U1 to U4 are arranged above the transfer surface 21B of the intermediate transfer belt 21. Each of the image forming units U1 to U4 forms an image in colors complementary to the separation colors. More specifically, the image forming units U1 to U4 include photosensitive drums 3Y, 3M, 3C, and 3B, respectively, that serve as image carriers carrying images of toners of the complementary colors (yellow, magenta, cyan, and black). The photosensitive drums 3Y, 3M, 3C, and 3B are arranged above the transfer surface 21B of the intermediate transfer belt 21 between rollers 2A and 2B, parallel to each other and orthogonal to the direction of movement of the intermediate transfer belt 21.

All the photosensitive drums 3Y, 3M, 3C, and 3B rotate in one direction (counterclockwise). Charging devices, developing devices, transfer bias rollers 6Y, 6M, 6C, and 6B that serve as primary transfer members, and cleaning devices are arranged around these drums to execute an image forming process during the rotation operation in accordance with a known technology. An optical writing unit 8 is arranged in such a manner that exposure lights output from the optical writing unit 8 pass between the charging device and the developing device and fall on a corresponding photosensitive drum.

Toners of different colors are contained in the developing devices. The intermediate transfer belt 21 spans across and around the roller (hereinafter, "driving roller" 2B and the roller (hereinafter, "driven roller" 2A, and is configured to move in the same direction as the photosensitive drums 3Y, 3M, 3C, and 3B under the photosensitive drums 3Y, 3M, 3C, and 3B. A cleaning device 9 is provided at a position facing the driven roller 2A to clean toner/dust on the transfer surface 21B of the intermediate transfer belt 21.

The transfer bias rollers 6Y, 6M, 6C, and 6B included in the transfer device 20 are opposed to the photosensitive drums 3Y, 3M, 3C, and 3B, respectively, in such a manner as to be in contact with these drums with the intermediate transfer belt 21 interposed therebetween. The belt and the corresponding photosensitive drums thereby form primary transfer units 10Y, 10M, 10C, and 10B. An opposing belt 26, which serves as a secondary transfer member, is arranged below the intermediate transfer belt 21 to be opposed to the intermediate transfer belt 21 on the side opposite to the primary transfer units 10Y, 10M, 10C, and 10B. A secondary transfer unit 15 is formed by the two belts 21 and 26. A secondary transfer bias, which will be described later, is applied to the secondary transfer unit 15.

How a yellow image is formed will be explained below. When forming a yellow image, the surface of the photosensitive drum 3Y is uniformly charged by the charging device, and an electrostatic latent image is created on the photosensitive drum 3Y in accordance with the exposure light incident from the optical writing unit 8. The electrostatic latent image is changed to a visible toner image by the developing device that contains yellow toner. Then, the toner image is primary-transferred onto the intermediate transfer belt 21 by the primary transfer unit 10Y to which a specific bias is applied.

Toner images of cyan, magenta, and black are created in a similar manner on the other photosensitive drums 3M, 3C, and 3B, and these toner images are then sequentially transferred and superimposed onto the intermediate transfer belt 21. The toner remaining on the photosensitive drums after the transfer is removed by the corresponding cleaning devices. After the toner images are transferred from the photosensitive drums 3Y, 3M, 3C, and 3B onto the intermediate transfer belt 21, electrostatic charges on the drums are neutralized by not-shown electric-charge neutralizers to prepare the drums for the next image forming operation.

The paper feeding section 1B includes paper feeding trays 1B1 in which paper sheets P are stacked and stored as recording media; paper feeding rollers 1B2 that separate paper sheets P in the paper feeding trays 1B1 and feed them sequentially from the top of the stack; a pair of carrier rollers 1B3 that carries the fed paper sheets P; and a pair of registration rollers 1B4 that brings a paper sheet P to a stop, corrects any displacement in an oblique direction, and then sends the sheet to the nip at a timing at which the leading end of the image on the intermediate transfer belt 21 matches a predetermined position in the carrying direction. A not-shown sensor is provided near the registration rollers 1B4 to detect the reflectance of the sheet surface so that the intermediate transfer belt 21 is exchanged when the output value of the sensor is different from the output value in the previous operation.

A toner image T (hereinafter, also "toner") primary-transferred from the photosensitive drums 3Y, 3M, 3C, and 3B onto the intermediate transfer belt 21 is secondary-transferred onto the paper sheet P when a not-shown secondary transfer bias applying unit in the secondary transfer unit 15 applies a secondary transfer bias (including superimposition of AC, pulses, and the like) to a secondary transfer bias applying member, which will be discussed later, under the action of an electric field between the secondary transfer bias applying member and a secondary transfer bias opposing member, which will also be discussed later, via the intermediate transfer belt 21. Thereafter, the paper sheet P onto the surface of which the toner image T is secondary-transferred is subjected to the action of heat and pressure by a fixing device 11 to fix the toner image thereon, and ejected through output rollers 12 into an output tray 13.

Thus, the primary transfer units 10Y, 10M, 10C, and 10B are configured by the transfer bias rollers 6Y, 6M, 6C, and 6B pressed from the back of the intermediate transfer belt 21 by not-shown bearings and compression springs via the intermediate transfer belt 21 against the corresponding photosensitive drums 3Y, 3M, 3C, and 3B under a certain amount of pressure. The positions at which the transfer bias rollers 6Y, 6M, 6C, and 6B are brought into contact with the intermediate transfer belt 21 is adjusted so that they are shifted 1 millimeter to 2 millimeters downstream from the center of the corresponding photosensitive drums. This is to avoid pre-transfer. The transfer bias rollers 6Y, 6M, 6C, and 6B are configured to rotate in accordance with the movement of the intermediate transfer belt 21.

Each of the transfer bias rollers 6Y, 6M, 6C, and 6B includes a metal shaft as a core and a rubber material having electric properties of medium resistance arranged around the metal shaft. More specifically, the rubber material is formed of medium-resistance foamed rubber. The volume resistivity of the transfer bias rollers is between $10^6$ Ω·cm and $10^{10}$ Ω·cm, more preferably between $10^8$ Ω·cm and $10^{10}$ Ω·cm. The rubber material is not limited to the foamed rubber, and medium-resistance solid rubber may be equally adopted.

The intermediate transfer belt 21 is formed of a medium-resistance resin such as polyimide (PI), polyamide-imide (PAI), polycarbonate (PC), and ethylene-tetrafluoroethylene (ETFE). The volume resistivity of the intermediate transfer belt 21 is between $10^6$ Ω·cm and $10^{10}$ Ω·cm, more preferably between $10^8$ Ω·cm and $10^{10}$ Ω·cm. The surface resistivity of the intermediate transfer belt 21 is between $10^6$ Ω·cm and $10^{12}$ Ω·cm, more preferably between $10^8$ Ω·cm and $10^{12}$ Ω·cm. The thickness of the intermediate transfer belt 21 can be between 50 and 100 micrometers, and the vertical elasticity can be 3000 mega pascals or greater so that the intermediate transfer belt 21 has a sufficient mechanical strength to sustain stretching, wrinkling, and rippling during the operation.

Next, the structure and operation of the secondary transfer unit 15 according to the first embodiment is explained in detail.

Figure 2:
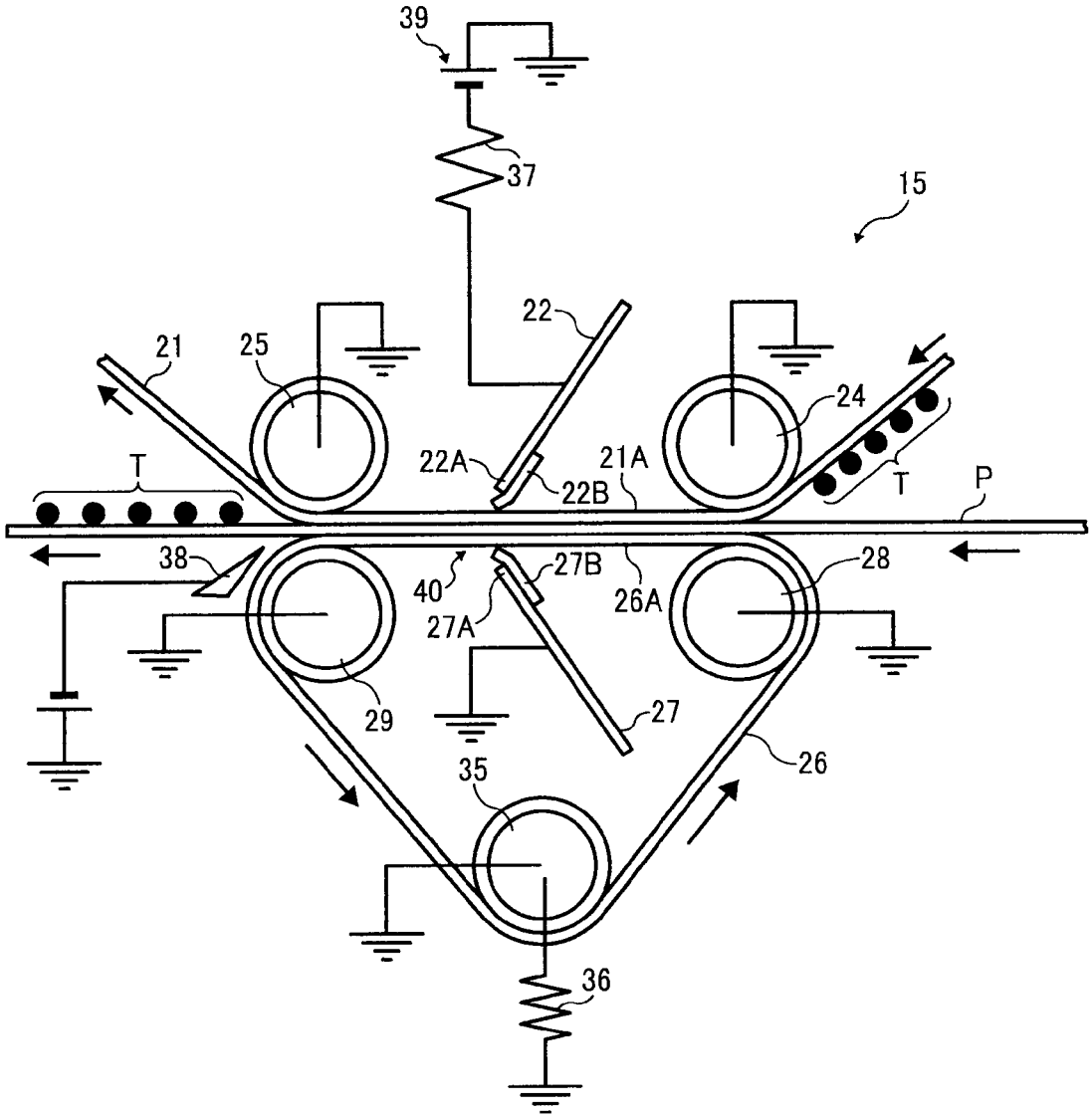
FIG. 2 is an enlarged view of a transfer device shown in FIG. 1.

FIG. 2 is a schematic diagram of the secondary transfer unit 15. The secondary transfer unit 15 has a secondary transfer nip 40. The secondary transfer nip 40 is formed of two belts: the intermediate transfer belt 21 and the opposing belt 26.

Of the rollers around which the intermediate transfer belt 21 is stretched, a secondary transfer inlet roller 24 and a secondary transfer outlet roller 25 on the side of the intermediate transfer belt 21 opposite to the transfer surface 21B are positioned apart from each other in the conveying direction of the paper sheet P, inside the intermediate transfer belt 21. A portion 21A of the intermediate transfer belt 21 that spans across the two rollers 24 and 25 runs substantially in a horizontal direction, forming a flat top surface of the nip. The secondary transfer inlet roller 24 and the secondary transfer outlet roller 25 are formed of a metal, and electrically grounded.

The opposing belt 26 is stretched around an opposing inlet roller 28, an opposing outlet roller 29, and a tension roller 35. The opposing inlet roller 28 and the opposing outlet roller 29 are opposed to the secondary transfer inlet roller 24 and the secondary transfer outlet roller 25, respectively, and the tension roller 35 is positioned below the rollers 28 and 29. In other words, the opposing inlet roller 28, the opposing outlet roller 29, and the tension roller 35 are positioned inside the opposing belt 26.

A portion 26A of the opposing belt 26 between the opposing inlet roller 28 and the opposing outlet roller 29 runs substantially in a horizontal direction, forming a flat bottom surface of the nip. The flat portions 21A and 26A are parallel to each other. In other words, the secondary transfer nip 40 is formed of the belts 21 and 26 to run substantially straight.

The secondary transfer inlet roller 24 and the secondary transfer outlet roller 25 are pressed against the opposing inlet roller 28 and the opposing outlet roller 29 that are positioned below the rollers 24 and 25. For this reason, the portions 21A and 26A of the two belts are brought into contact with each other under pressure, and the opposing belt 26 rotates in accordance with the rotational operation of the intermediate transfer belt 21. The opposing inlet roller 28 and the opposing outlet roller 29 are both electrically grounded. The tension roller 35 is pulled downward by a tension spring 36. Because of the tension applied by the tension spring 36 on the tension roller 35, the opposing belt 26 rotates smoothly.

A secondary transfer blade 22, which acts as a secondary transfer bias applying member that applies a secondary transfer bias, is provided inside the intermediate transfer belt 21. An opposing blade 27, which serves as a secondary transfer bias opposing member, is provided inside the opposing belt 26 to be opposed to the secondary transfer blade 22. The secondary transfer blade 22 and the opposing blade 27 are both shaped into plates and exhibit conductivity. The secondary transfer blade 22 and the opposing blade 27 are positioned in such a manner that tips 22A and 27A thereof are in contact with the inside surfaces of the portions 21A and 26A, respectively, approximately in the middle of the secondary transfer nip 40.

A transfer bias of the same polarity as that of the toner is applied to the secondary transfer blade 22 so that the toner image T carried on the intermediate transfer belt 21 is transferred onto the recording medium P (repulsion transferring system). A resistor 37 of 1 mega ohm to 10 mega ohms is connected between a secondary transfer power supply 39 and the secondary transfer blade 22 so that a secondary transfer current of 20 microamperes to 40 microamperes is fed to the secondary transfer blade 22. On the other hand, the opposing blade 27 is grounded, forming a circuit to which the secondary transfer current is fed. In other words, the secondary transfer unit 15 is configured in such a manner that the secondary transfer bias is applied substantially to the center portion of the secondary transfer nip 40.

A tip supporting sheet 22B is attached to the tip 22A of the secondary transfer blade 22 and a tip supporting sheet 27B is attached to the tip 27A of the opposing blade 27. The secondary transfer blade 22 is in contact with the intermediate transfer belt 21 by way of the tip supporting sheet 22B and the opposing blade 27 is in contact with the opposing belt 26 by way of the tip supporting sheet 27B. It is preferable that the tip supporting sheets 22B and 27B be formed of a film, sheet, and belt materials to have a thickness of 10 micrometers to 100 micrometers. Excellent slip, attachment, and subservience can be achieved with respect to the inner surfaces of the intermediate transfer belt 21 and the opposing belt 26 by incorporating a resin sheet material of a medium resistance, a belt material of the same quality, thickness, and electric properties as those of the intermediate transfer belt 21, and a thin resin film material of a high resistance. Especially for the secondary transfer blade 22, such a tip supporting sheet 22B satisfies the electric properties to act as a bias applying member. As a specific material of the tip supporting sheet, a 50- to 100-micrometer-thick PFA sheet having a resistance of approximately 104 ohms to 106 ohms would be preferable. Resin coating may be applied on the tip 22A of the secondary transfer blade 22 with a coating material having the same properties as those of the tip supporting sheet 22B.

Regarding the nip formed by the above two blades 22 and 27, it is preferable that the secondary transfer be conducted in the top and bottom belt-wound nip, or in other words the secondary transfer nip 40, and that the effective electric field nip for the secondary transfer be a narrow area. According to the present embodiment, the nip is defined in the range of 0.5 millimeter to 1.5 millimeters. Because the effective electric field nip for the secondary transfer is generated in the range of 0.5 millimeter to 1.5 millimeters around the contact areas of the tips 22A and 27A, the secondary transfer electric field can be narrowed in the paper feeding direction.

The intermediate transfer belt 21 that carries thereon the toner image T moves clockwise during image formation. The opposing belt 26, which is brought into contact with the intermediate transfer belt 21 under pressure, moves counterclockwise. For this reason, the portions 21A and 26A, which are the sections of the belts 21 and 26 that are opposed to each other, move in the same direction in the secondary transfer nip 40.

In synchronism with the leading edge of the image on the intermediate transfer belt 21, the paper sheet P is fed from the paper feeding section 1B into the secondary transfer nip 40 from the right side of FIG. 2. The paper sheet P in the secondary transfer nip 40 is nipped and carried by the linearly designed secondary transfer nip 40. Because the secondary transfer inlet roller 24 and the opposing inlet roller 28 are both grounded, the problem of pre-transfer does not occur.

The secondary transfer unit 15 performs the secondary transfer operation on the paper sheet P that enters the secondary transfer nip 40. The paper sheet P is nipped by the horizontal, flat secondary transfer nip 40 that is formed of the intermediate transfer belt 21 and the opposing belt 26, and the secondary transfer bias is applied to approximately the center portion of the nip. The toner image T on the intermediate transfer belt 21 is thereby secondary-transferred onto the paper sheet P. The paper sheet P with the toner image T is then carried to the left side of FIG. 2 (downstream of the paper carrying direction), where it is removed from the secondary transfer nip 40. With the grounded secondary transfer outlet roller 25 arranged on the inside of the intermediate transfer belt 21 in the outlet area of the secondary transfer nip 40, electrostatic charge on the intermediate transfer belt 21 generated during the secondary transfer can be discharged to the ground. Thus, it is very unlikely that the polarity of toner is affected by discharging that otherwise tends to occur when the toner image T is removed from the intermediate transfer belt 21.

A separation static eliminating unit 38 is arranged in the secondary transfer outlet area on the side opposite to the transfer side of the paper sheet P carrying the toner image T, below the paper sheet P. A bias of −1 kilovolt to −3 kilovolts is applied to the separation static eliminating unit 38. With this arrangement, separation discharge is prevented from being generated when the paper sheet P is removed from the intermediate transfer belt 21 and the opposing belt 26, which ensures stable separation performance.

Thus, the secondary transfer nip 40 is formed substantially linearly with the intermediate transfer belt 21 and the opposing belt 26. With this arrangement, the secondary transfer nip 40 forms a substantially linear carrying path, and thus the paper sheet P that passes through the secondary transfer nip 40 can be prevented from being jammed, curled, and skewed. Hence, the reliability can be improved in carrying the paper sheet P, and furthermore, the primary-transferred toner image can be transferred from the intermediate transfer belt 21 onto the paper sheet P in excellent condition. In addition, because the secondary transfer bias is applied to the center portion of the secondary transfer nip 40, the width of the secondary transfer nip 40 in the direction of carrying the paper sheet P can be made narrower. A narrower width is effective in reducing pre-transfer that tends to be caused by the electric field in the inlet area of the secondary transfer nip 40 and disturbance of the tone image that tends to be caused by discharging in the outlet area. As a result, the primary-transferred toner image can be transferred from the intermediate transfer belt 21 onto the paper sheet P in excellent condition.

Figure 3:
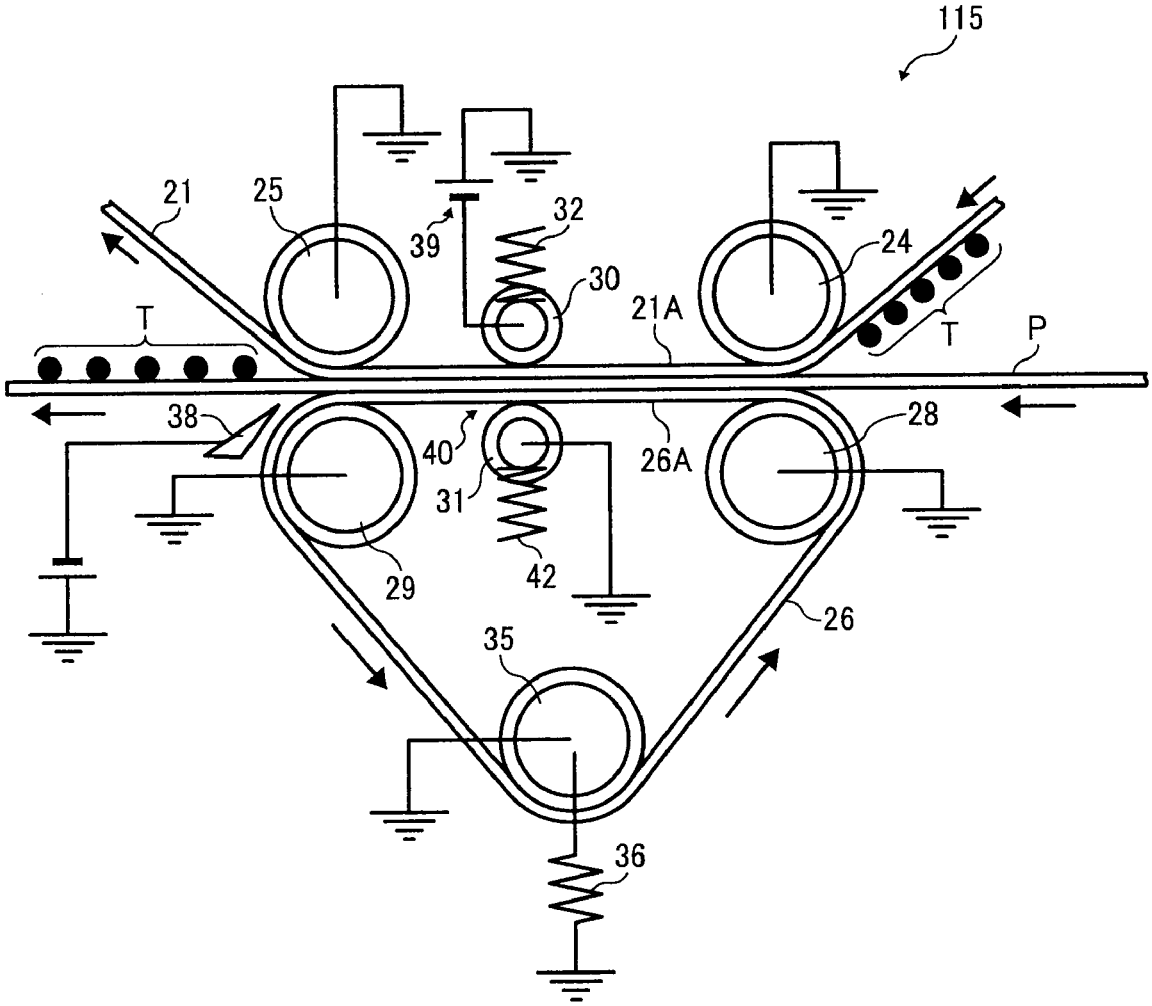
FIG. 3 is an enlarged view of a transfer device according to a second embodiment of the present invention.

FIG. 3 is a schematic diagram of a secondary transfer unit 115 according to a second embodiment of the present invention. The secondary transfer unit 115 can be used in place of the secondary transfer unit 15 in the color copier 1 shown in FIG. 1. In the secondary transfer unit 115, the secondary transfer bias applying member arranged on the inside of the intermediate transfer belt 21 is formed of a secondary transfer roller 30 that is a rotating member, and the secondary transfer bias opposing member arranged on the inside of the opposing belt 26 is formed of an opposing roller 31. The secondary transfer roller 30 is pushed downward by a tension spring 32 and the opposing roller 31 is pushed upward by a tension spring 42. The rest of the structure is almost the same as that of the secondary transfer unit 15.

The secondary transfer power supply 39 applies a secondary transfer bias of the same polarity as that of the toner to the secondary transfer roller 30 (repulsion transferring system). The secondary transfer roller 30 includes a metal shaft as a core and a rubber material having an electric property of a medium resistance arranged around the metal shaft, and exhibits conductivity. More specifically, the rubber material is a medium-resistance foamed rubber, which has a volume resistance of $10^6$ Ω·cm to $10^{10}$ Ω·cm, more preferably $10^8$ Ω·cm to $10^{10}$ Ω·cm. However, the rubber material is not limited to the foamed rubber, and a medium-resistance solid rubber may also be adopted. The opposing roller 31 exhibits conductivity and is grounded. The structure of the opposing roller 31 can be roughly the same as that of the secondary transfer roller 30 or different.

Even in the second embodiment, the secondary transfer nip 40 is formed substantially linearly with the intermediate transfer belt 21 and the opposing belt 26. For this reason, the secondary transfer nip 40 forms an approximately straight carrying path, which reduces jams, curls, and skews of the paper sheet P that passes through the secondary transfer nip 40. This improves the reliability in carrying the paper sheet P. Furthermore, the secondary transfer bias is applied to approximately the center portion of the secondary transfer nip 40 by the secondary transfer roller 30 that is in line contact with the intermediate transfer belt 21. The opposing roller 31 is also in line contact with the opposing belt 26. As a result, the widths of the secondary transfer nip 40 and the effective electric field nip can be reduced with respect to the carrying direction of the paper sheet P, which reduces pre-transfer that tends to occur due to the electric field in the inlet area of the secondary transfer nip 40 and disturbance of the toner image that tends to occur due to discharging in the outlet area. This means that the primary-transferred toner image can be transferred from the intermediate transfer belt 21 onto the paper sheet P in excellent condition.

To reduce the width of the effective electric field nip of the secondary transfer unit 15, the secondary transfer roller 30 and the opposing roller 31 should be configured to have small diameters. The diameter of the secondary transfer roller 30 and the opposing roller 31 is preferably between 8 millimeters and 12 millimeters. Because this arrangement further reduces the width of the effective electronic field nip of the secondary transfer nip 40, disturbance of the toner image can be suppressed in the secondary transfer nip 40.

Figure 7:
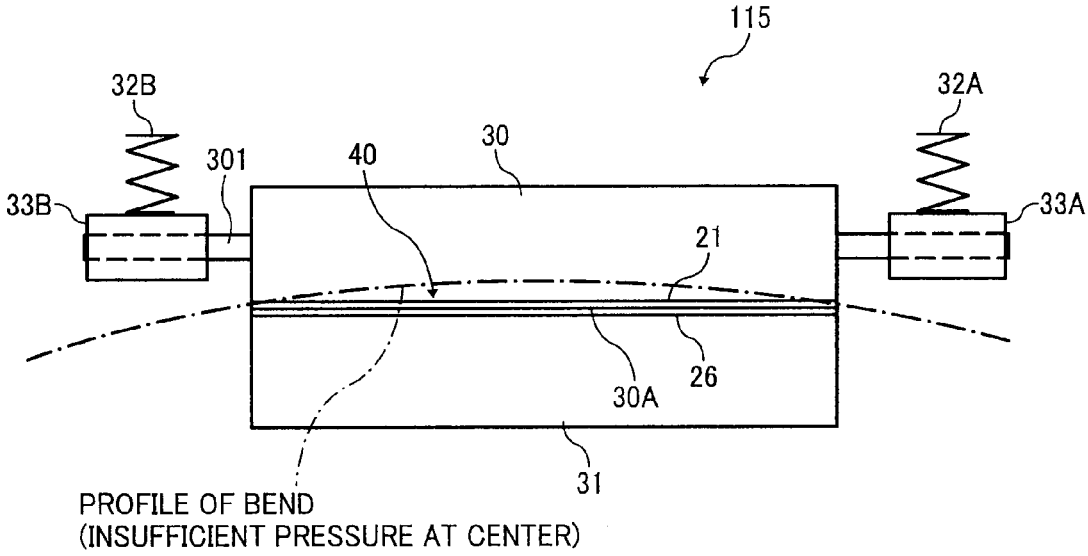
FIG. 7 is a schematic view for explaining the problems that occur if the supporting structure illustrated in FIG. 6 is not provided.

On the other hand, with the rollers of the small the diameter, bending may occur under pressure on the end portions of the rollers. FIG. 7 is a diagram for explaining the small-diameter rollers the end portions of which receive pressure. For example, a shaft 301 of the secondary transfer roller 30 is rotatably supported by bearings 33A and 33B at its end portions, and pressure is applied to these bearings 33A and 33B toward the opposing roller 31 by the spring 32 (32A and 32B), which act as pressure applying members. When the secondary transfer roller 30 is in line contact with the opposing roller 31, the shaft 301 may bend, and a center portion 30A of the secondary transfer roller 30 may be deformed and shifted away from the opposing roller 31, as indicated by double-dashed line in the drawing. As a result, the center portion 30A receives insufficient contact pressure. In the worst case, the center portion 30A may not come in contact with the opposing roller 31, i.e. space may be created between the two rollers 30 and 31. If this happens, the transfer electronic field cannot be obtained, which causes a transfer failure in the center portion of the image. The resultant image may be insufficient in density or end up with an error image.

Figure 6:
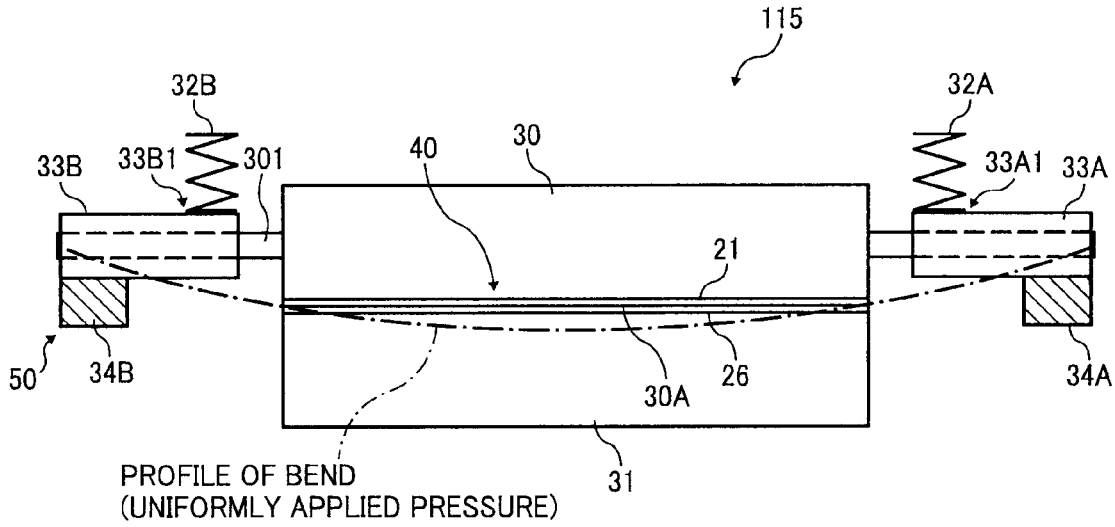
FIG. 6 is a schematic view of a supporting structure that supports the secondary transfer roller shown in FIG. 3.

To solve such a problem, a supporting structure 50 that supports the secondary transfer roller 30 (bearings 33A and 33B) is arranged as illustrated in FIG. 6. Because the secondary transfer roller 30 is supported by the supporting structure 50, the secondary transfer roller 30 is bent at the center portion 30A toward the opposing roller 31 as indicated by double-dashed line when the springs 32A and 32B of the same tension apply pressure to the bearings 33A and 33B arranged on the two end portions of the shaft 301 of the secondary transfer roller 30 toward the opposing roller 31. The supporting structure 50 includes bearing supporting members 34A and 34B arranged at positions outside in the axial direction of the secondary transfer roller 30 with respect to pressure applied portions 33A1 and 33B1 of the bearings 33A and 33B pressed by the springs 32A and 32B, on the surface of the bearings 33A and 33B opposite to the pressure applied portions 33A1 and 33B1, respectively. Furthermore, the bearings according to the embodiment are extended and widened in the axial direction. In other words, the bearing supporting members 34A and 34B are arranged on the bottom of the wide bearings 33A and 33B at their very end portions, and the springs 32A and 32B are positioned inside with respect to the bearing supporting members 34A and 34B to press the bearings 33A and 33B toward the opposing roller 31. According to the present embodiment, as illustrated in FIG. 3, the opposing roller 31 is also pressed by the spring 42 (42A and 42B) toward the secondary transfer roller 30.

With such a supporting structure 50, even when the secondary transfer roller 30 has a small-diameter roller, it can bend at the center portion 30A toward the opposing roller 31. Thus, a problem as illustrated in FIG. 7 where the center portion 30A of the secondary transfer roller 30 is detached from the opposing roller 31 is prevented. In other words, a problem of the secondary transfer roller 30 receiving insufficient pressure at the center portion 30A and creating a gap between the rollers is avoided. A stable transfer electric field can be thereby obtained, which reduces transfer failure in the center portion and avoids insufficient image density and error images. In other words, the primary-transferred toner image can be transferred from the intermediate transfer belt 21 onto the paper sheet P in excellent condition. Contact pressure can be evenly distributed on the roller by optimizing the pressure of the pressing springs 32A and 32B in accordance with the diameter of the roller shaft.

Figure 4:
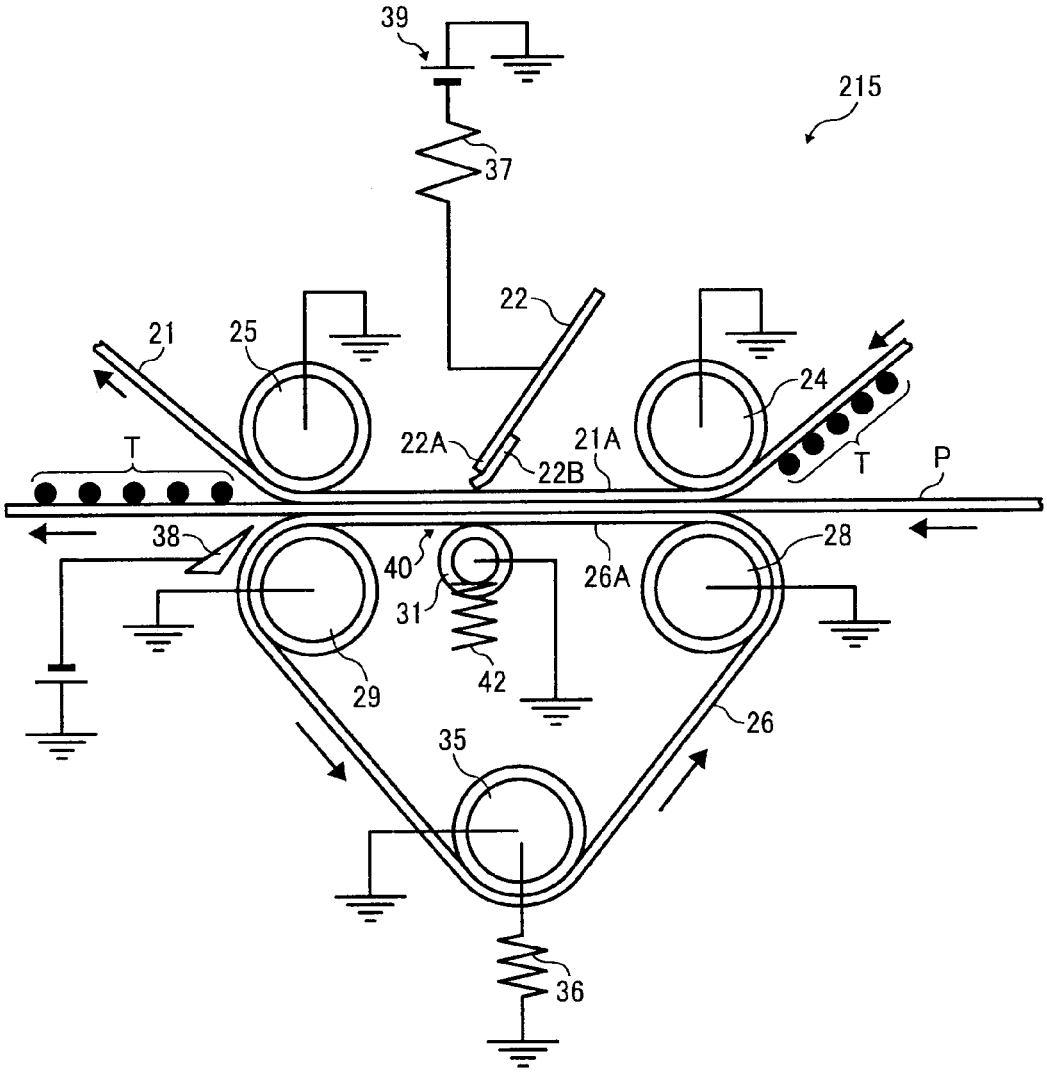
FIG. 4 is an enlarged view of a transfer device according to a third embodiment of the present invention.

The structures of the secondary transfer bias applying member and the secondary transfer bias opposing member is not limited to those explained above in the first and second embodiments. For example, as illustrated in FIG. 4, a secondary transfer unit 215 according to a third embodiment of the present invention may be constituted by adopting the secondary transfer blade 22 incorporated in the first embodiment for the secondary transfer bias applying member arranged on the inside of the intermediate transfer belt 21 and the opposing roller 31 incorporated in the second embodiment for the secondary transfer bias opposing member arranged on the inside of the opposing belt 26. The secondary transfer unit 215 can be used in place of the secondary transfer unit 15 in the color copier 1 shown in FIG. 1.

Figure 5:
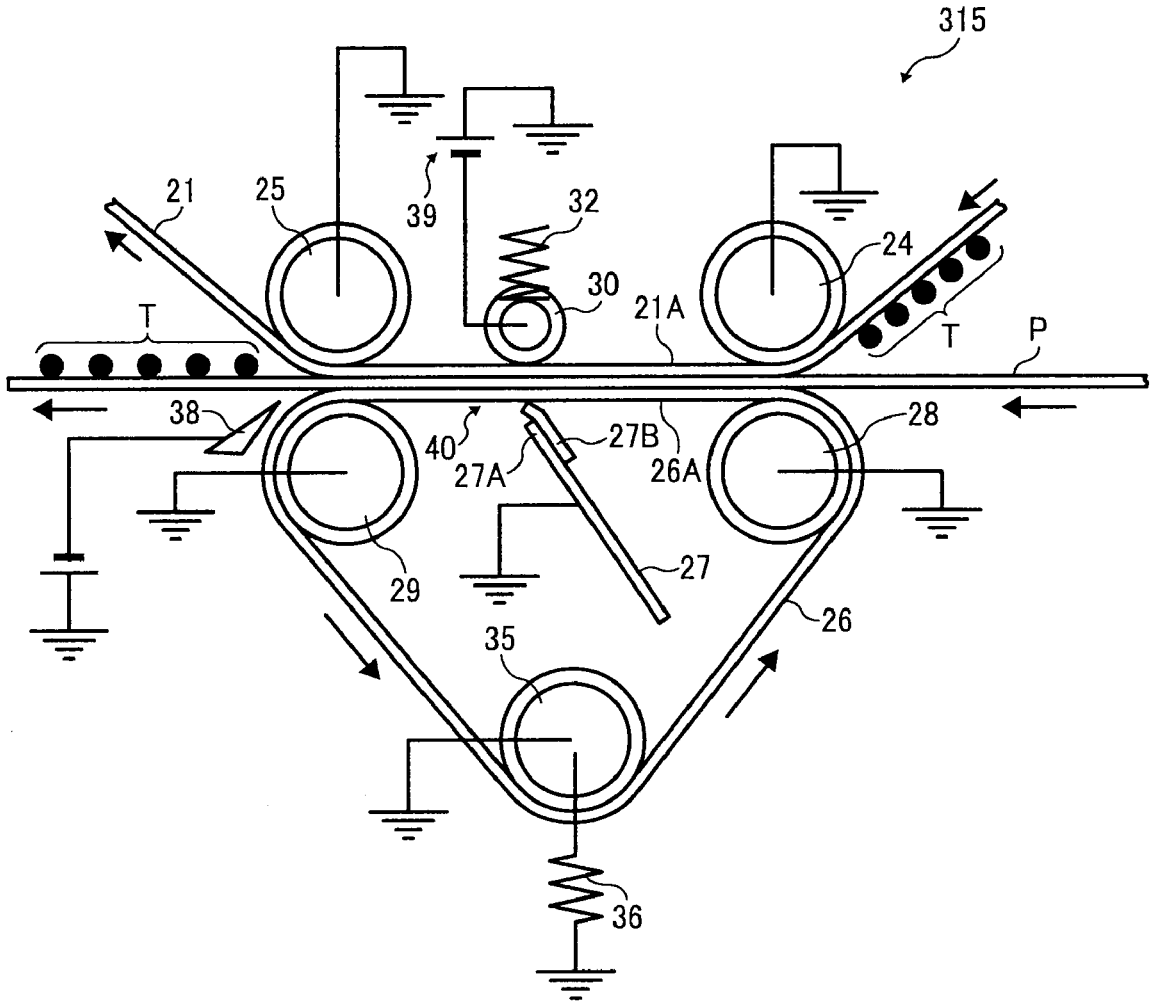
FIG. 5 is an enlarged view of a transfer device according to a fourth embodiment of the present invention.

Alternatively, as illustrated in FIG. 5, a secondary transfer unit 315 according to a fourth embodiment of the present invention may be configured by adopting the secondary transfer roller 30 incorporated in the second embodiment for the secondary transfer bias applying member arranged on the inside of the intermediate transfer belt 21 and the opposing blade 27 incorporated in the first embodiment for the secondary transfer bias opposing member arranged on the inside of the opposing belt 26. The secondary transfer unit 315 can be used in place of the secondary transfer unit 15 in the color copier 1 shown in FIG. 1.

In any of the above embodiments, the secondary transfer nip 40 is formed linearly with the intermediate transfer belt 21 and the opposing belt 26, and thus the secondary transfer nip 40 is designed as substantially a linear carrying path. As a result, the paper sheet P that passes through the secondary transfer nip 40 is prevented from being jammed, curled, or skewed, which improves reliability in carrying the paper sheet P. Furthermore, because the secondary transfer bias is applied to substantially the center portion of the secondary transfer nip 40, the width of the secondary transfer nip 40 can be reduced in the carrying direction of the paper sheet P. Then, pre-transfer due to the electric field in the inlet area of the secondary transfer nip 40 and the disturbance of the toner image due to discharging in the outlet area can be suppressed. Thus, the primary-transferred toner image can be transferred from the intermediate transfer belt 21 onto the paper sheet P in excellent condition.

According to an aspect of the present invention, the secondary transfer nip, where a toner image is transferred from an intermediate transfer body to a recording medium, is formed substantially linearly with two (or more) belt members including the intermediate transfer body. In other words, the nip forms substantially a linear carrying path. Hence, jams, curls, and skews of the recording medium that passes through the secondary transfer nip can be reduced, which improves reliability in carrying the recording medium and transfers the primary-transferred toner image from the intermediate transfer body to the recording medium in excellent condition. In addition, a secondary transfer bias is applied to approximately the center portion of the secondary transfer nip. When this structure is adopted, it is possible to reduce the width of the secondary transfer electric field of the secondary transfer nip in the recording medium carrying direction. Hence, pre-transfer due to the electronic field in the inlet area of the secondary transfer nip and toner image disturbance due to discharging in the outlet area can be suppressed. As a result, the primary-transferred toner image can be transferred from the intermediate transfer body to the recording medium in excellent condition.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device that includes at least two belt members constituting a secondary nip portion therebetween and that electrostatically transfers a toner image from one of the belt members onto a recording medium when the recording medium passes through the secondary nip portion, the transfer device comprising:

a mechanism that supports the belt members such that the secondary nip portion is substantially linear;

a bias applying device that applies a secondary transfer bias at a substantially center portion of the secondary nip portion; and a plurality of roller members that rotatably support the belt members so that belt members form loops, wherein the bias applying device includes a secondary transfer bias applying member that applies the secondary transfer bias and is arranged inside a loop of one of the belt members, and a secondary transfer bias opposing member arranged inside a loop of another one of the belt members in such a manner as to be opposed to the secondary transfer bias applying member, and at least one of the secondary transfer bias applying member and the secondary transfer bias opposing member is formed of a rotatory member having electrical conductivity, wherein both the secondary transfer bias applying member and the secondary transfer bias opposing member are formed of a rotatory member having electrical conductivity, and the transfer device further comprising a supporting structure that supports one of the rotatory members in such a manner that, when a pressure is applied by a pressure applying member to bearings arranged on two end portions of the one of the rotatory members toward the other one of the rotatory members, the one of the rotatory members bends at a center portion thereof toward the other one of the rotatory members.

2. The transfer device according to claim 1, wherein the supporting structure includes bearing supporting members that are arranged at outside positions in an axial direction of the one of the rotatory members with respect to pressed portions of the bearings that are pressed by the pressure applying members, on a surface of the bearings opposite to the pressed portions.

* * * * *